US009655386B2

(12) United States Patent
Hendrickson

(10) Patent No.: US 9,655,386 B2
(45) Date of Patent: May 23, 2017

(54) NURSING GARMENTS

(71) Applicant: Destination Maternity Corporation, Philadelphia, PA (US)

(72) Inventor: Lisa A. Hendrickson, Mount Laurel, NJ (US)

(73) Assignee: Destination Maternity Corporation, Philadelphia, PA (US)

( * ) Notice: Subject to any disclaimer, the term of this patent is extended or adjusted under 35 U.S.C. 154(b) by 359 days.

(21) Appl. No.: 14/332,642

(22) Filed: Jul. 16, 2014

(65) Prior Publication Data

US 2016/0015091 A1 Jan. 21, 2016

(51) Int. Cl.
*A41C 3/04* (2006.01)
*A41D 1/20* (2006.01)

(52) U.S. Cl.
CPC ..... *A41C 3/04* (2013.01); *A41D 1/205* (2013.01)

(58) Field of Classification Search
CPC .. A41C 1/06; A41C 3/02; A41C 3/148; A41C 3/14; A41C 3/0057
USPC ..... 450/2–4, 7, 8, 11, 19–21, 31, 59–62, 450/65–67, 70, 74–76
See application file for complete search history.

(56) References Cited

U.S. PATENT DOCUMENTS 2,800,659 A * 7/1957 Hazard ..... A41C 1/06 450/27
3,116,735 A * 1/1964 Geimer ..... A61F 5/026 128/DIG. 19
5,033,986 A * 7/1991 Feigenbaum ..... A41C 3/0057 2/67
5,823,851 A * 10/1998 Dicker ..... A41C 3/02 2/73
7,048,013 B2 5/2006 Shannon
7,159,621 B2 1/2007 Shannon
7,549,302 B2 6/2009 Duckham et al.
7,654,115 B2 2/2010 Duckham et al.
2006/0089083 A1* 4/2006 Tonsor ..... A41C 3/02 450/60
2009/0068908 A1 3/2009 Hinchcliff
2009/0081924 A1* 3/2009 Puyaubreau ..... A41C 3/14 450/39
2011/0003533 A1 1/2011 Caruso et al.
2011/0281497 A1* 11/2011 Van Dorp ..... A41C 3/148 450/31
2012/0060253 A1 3/2012 Bergin et al.
2012/0144548 A1 6/2012 Quaranta

* cited by examiner

*Primary Examiner* — Gloria Hale
(74) *Attorney, Agent, or Firm* — DLA Piper LLP (US)

(57) ABSTRACT

Garments, including nursing garments configured as pull-over bras and camisoles, are disclosed. Nursing garments include a frontal portion configured to provide under-breast support connected to a first breast pocket and a second breast pocket, which are each configured to cover the breasts and may provide additional breast support. At least one of the first and second breast pockets is configured to cover at least one of the wearer's breasts when the breast pocket is in a first position, and to uncover and expose at least one of the wearer's breasts when in a second position. The frontal portion, the first breast pocket and the second breast pocket are also connected to a back portion, which provides back support for the wearer whether one or both of the first or second breast pockets are in the first position or in the second position.

26 Claims, 7 Drawing Sheets

NURSING GARMENTS

TECHNICAL FIELD

This disclosure relates generally to garments, and more specifically to garments that provide breast and back support for pregnant and nursing mothers.

BACKGROUND

In general, a bra is an article of clothing that covers, supports and raises the breasts. Traditional bras have two cups to hold the breasts, shoulder straps connected to each of the cups, and a band encircling the torso under the breasts. However, traditional bras do not provide convenient access to the breasts or extra support that is needed by nursing mothers.

Nursing bras have been created that provide additional support for heavier breasts and permit comfortable breastfeeding without removal of the bra. Breastfeeding may be accomplished by opening specialized bra cups that expose the nipple. Some specialized cups include flaps of fabric over the cup that can be unclipped and pulled down to expose the breast. However, nursing bras with specialized cups and flaps are cumbersome and typically require an underwire, which may be uncomfortable after long periods of use.

Other nursing bras comprise cups made of stretchable fabric that can be pulled to the side for access to the breast. However, traditional stretchable nursing bras may not provide sufficient support for the breasts and back when a breast is exposed during breastfeeding. Bras that do not provide sufficient support during breastfeeding may make breast feeding difficult and uncomfortable. Additionally, nursing bras and traditional bras do not provide coverage of the abdomen and require the use of one or more outer layers of clothing.

Accordingly, there is a need for nursing garments that provide sufficient support for the wearer's breasts and back and allow nursing mothers to comfortably breastfeed their children. There is also a need for nursing garments that can be worn without layering other articles of clothing over a bra.

SUMMARY

The present disclosure provides garments suitable for pregnant and nursing mothers that provide support for the wearer's breasts and back, including during breastfeeding. The garments have a frontal portion that extends across a front side of a wearer's torso and has an upper edge portion that extends horizontally across the wearer's torso under a wearer's breasts adjacent a wearer's inframammary line and curves along a wearer's inframammary crease at outer lateral sides of the wearer's breasts. A back portion is connected to the frontal portion at lateral sides of the wearer's torso. The back portion includes a first segment of elastic material extending from a position along the left lateral side of the wearer's torso across a back side of the wearer's torso to an area above the wearer's right shoulder, and a second segment of the elastic material extending from a position along the right lateral side of the wearer's torso across the back side of the wearer's torso to an area above the wearer's left shoulder, such that the first and second segments form an 'X' across said back side.

The garments include a first breast pocket connected at an upper end to the first segment of the back portion at the area above the wearer's right shoulder and connected at a lower end to the upper edge portion of the frontal portion. Similarly, a second breast pocket is connected at an upper end to the second segment of the back portion at the area above the wearer's left shoulder and connected at a lower end to the upper edge portion of the frontal portion. At least one of the first and second breast pockets is configured to cover at least one of the wearer's breasts when said breast pocket is in a first position, and to uncover and expose at least one of the wearer's breasts when in a second position. Additionally, the frontal portion and upper edge portion of the frontal portion are configured to remain in place to support the wearer's breasts whether one or both of the first and second breast pockets are in the first position or in the second position.

DETAILED DESCRIPTION

Figure 1:
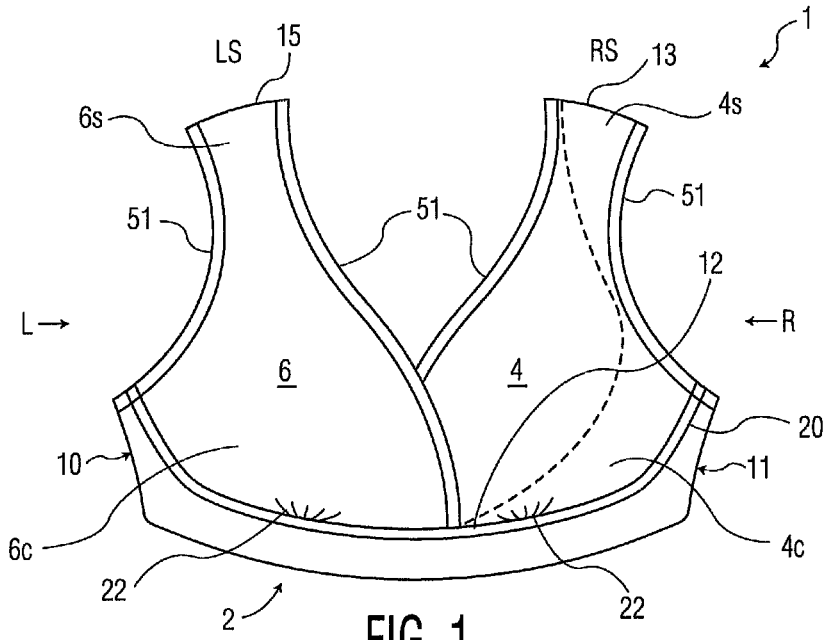
FIG. 1 is a front view of an exterior of a front side of an exemplary nursing garment.

The garments of this disclosure are suitable for pregnant and nursing mothers and provide support for the wearer's breasts and back, including during breastfeeding. It will be appreciated that the following description is intended to refer to specific examples of structure selected for illustration in the drawings and is not intended to define or limit the disclosure, other than in the appended claims.

Figure 3:
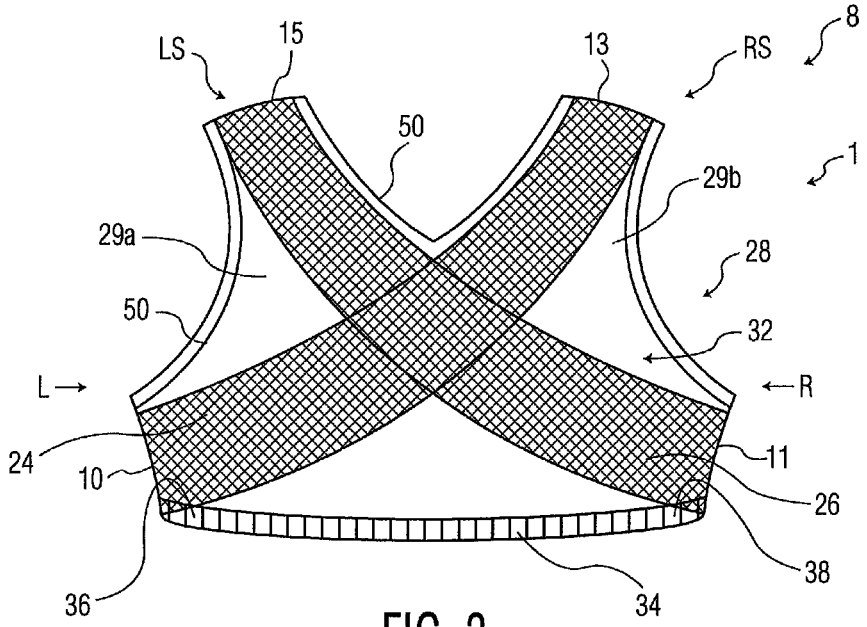
FIG. 3 is a view of an interior of a back side of the exemplary nursing garment shown in FIG. 1.
Figure 4:
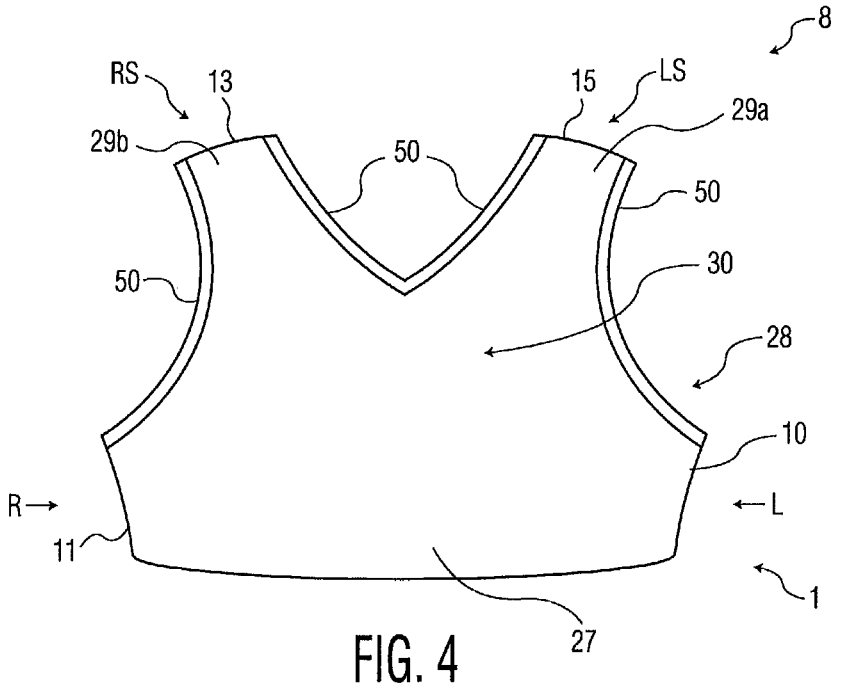
FIG. 4 is a rear view of an exterior of the back side of the exemplary nursing garment shown in FIG. 1.
Figure 5:
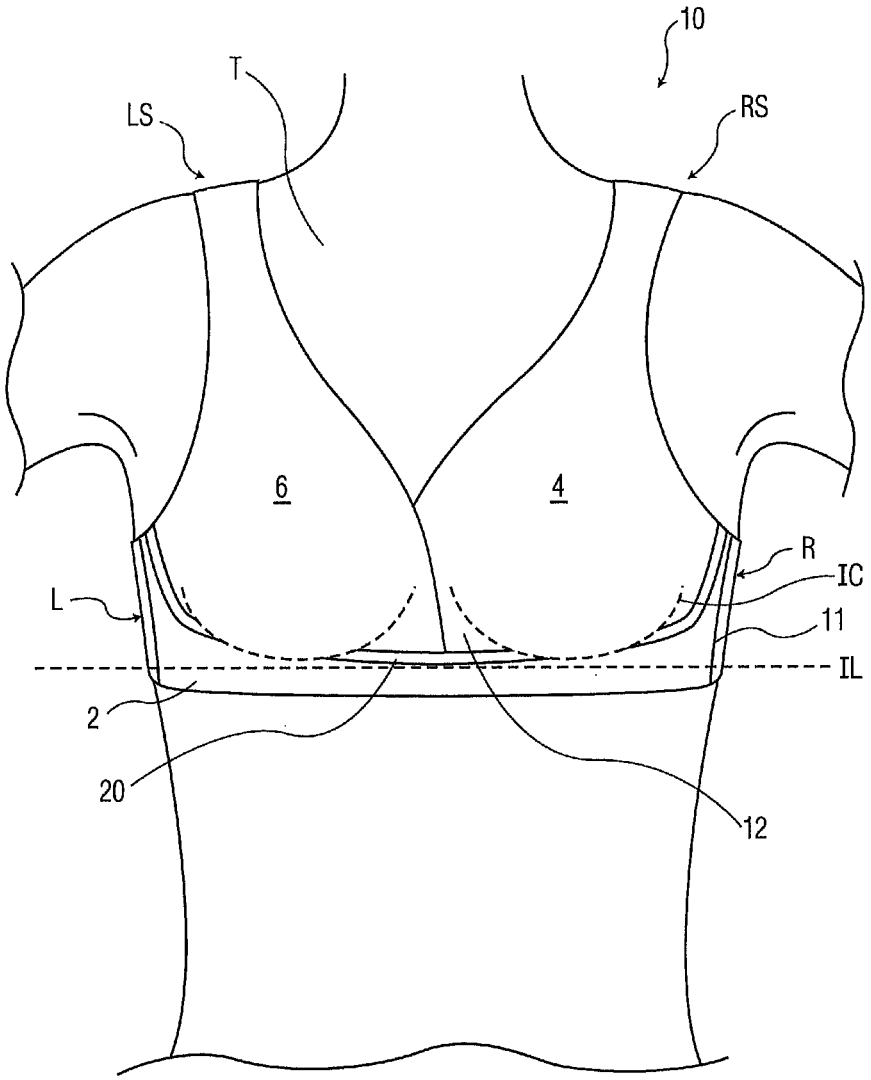
FIG. 5 is a perspective view of the exemplary nursing garment of FIG. 1 on a wearer's body.

Referring now to the drawings, wherein like reference numerals designate identical or corresponding parts throughout the several views, FIGS. 1-4 illustrate various views of an exemplary nursing garment 1 and FIG. 5 illustrates the exemplary nursing garment 1 on a wearer's body. As shown, nursing garment 1 is configured as a pull-over bra. The nursing garment 1 has a frontal portion 2 configured to provide under-breast support connected to a first breast pocket 4 and a second breast pocket 6, which are each configured to cover the breasts and may provide additional breast support. At least one of the first or second breast pockets 4, 6 is configured to cover at least one of the wearer's breasts when the breast pocket 4, 6 is in a first position, and to uncover and expose at least one of the wearer's breasts when in a second position. The frontal portion 2, the first breast pocket 4, and the second breast pocket 6 are also connected to a back portion 8, which provides back support.

As best seen in FIGS. 1 and 5, the frontal portion 2 is formed from at least one layer of fabric material extending across a front side of a wearer's torso (T). An upper edge portion 12 of the frontal portion 2 extends horizontally across the wearer's torso (T) under a wearer's breasts adjacent a wearer's inframammary line (IL) and curves along a wearer's inframammary crease (IC) at outer lateral sides of the wearer's breasts. Preferably, the frontal portion 2 and upper edge 12 portion of the frontal portions are configured to remain in place to support the wearer's breasts whether one or both of the first and second breast pockets 4, 6 are in the first position or in the second position.

Figure 2:
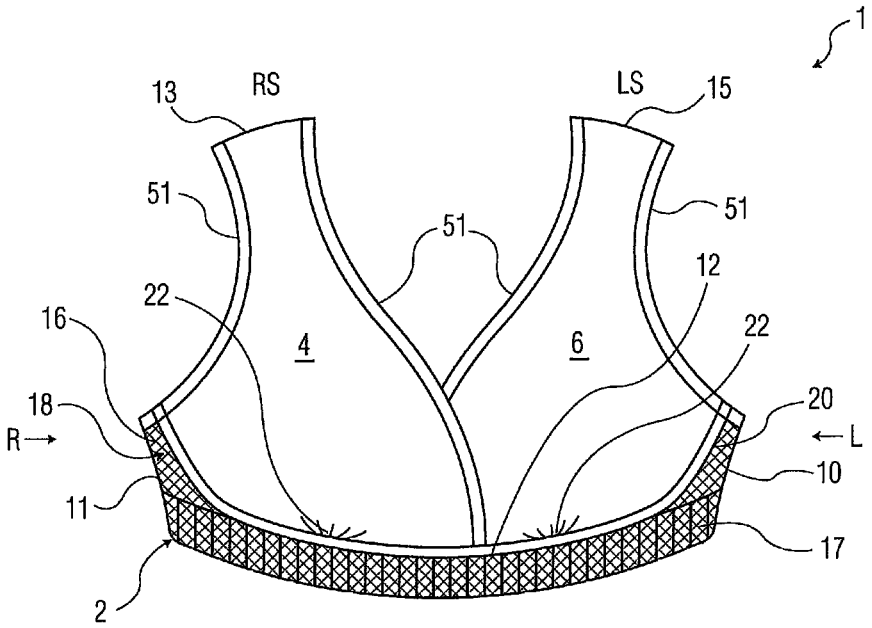
FIG. 2 is a view of an interior of the front side of the exemplary nursing garment shown in FIG. 1.

As shown in FIG. 2, the frontal portion 2 may further include a front elastic material 16 (also referred to as a "third segment of elastic material") extending along at least a portion of an inner surface 18 of the frontal portion 2 to hold and support the breasts. If included, the front elastic material 16 may extend horizontally across a front side of the wearer's torso (T) under a wearer's breasts from a position along the left lateral side (L) of the wearer's torso to a position along the right lateral side (R) of the wearer's torso (T). Optionally, the front elastic material 16 may be anchored to a seam 10 joining the frontal portion 2 and back portion 8 along the left lateral side (L) of the wearer's torso (T) and to a seam 11 joining the frontal portion 2 and back portion 8 along the right lateral side (R) of the wearer's torso (T). The front elastic material 16 may be formed from a stretchable fabric, such as power mesh material or the like. Optionally, the elastic material may be bias cut.

Additionally, or alternatively, the frontal portion 2 may also include an elastic band 17 to further support the breasts. The elastic band 17 may extend horizontally across a front side of the wearer's torso (T) under a wearer's breasts from a position along the left lateral side (L) of the wearer's torso to a position along the right lateral side (R) of the wearer's torso (T). The elastic band 17 may be attached to the frontal portion 2 at a position extending horizontally across the wearer's torso (T) under a wearer's breasts. The elastic band 17 may also be positioned inside a tubular hemline (not shown) of the frontal portion 2.

The frontal portion 2 may further include an inner lining (not shown) attached to the frontal portion 2 on a side facing the inner surface 18 such that the first elastic material 16 and elastic band 17, if included, are positioned between the frontal portion 2 and an inner lining of the frontal portion 2. The inner lining may be self-fabric and inner facing surfaces of the frontal portion may suitably be seamless.

FIGS. 1 and 2 show the frontal portion 2 of the garment 1 including an optional wireless support channel 20 extending along the upper edge portion 12 to provide further support for the breasts. The wireless support channel 20 is configured to extend horizontally across the wearer's torso (T) under a wearer's breasts adjacent the wearer's inframammary line (IL) and curve along the wearer's inframammary crease (IC) at outer lateral sides of the wearer's breasts. As shown in FIG. 1, the wireless support channel 20 is connected to the upper edge portion 12 such that the wireless support channel 20 is located between the first and second breast pockets 4, 6 and the upper edge portion 12. The wireless support channel 20 may also be attached to a portion of the first elastic material 16 and/or the frontal portion 2. Suitably, the wireless support channel 20 is flexible and resists expansion. The construction of the wireless support channel 20 may be formed by multiple layers of stitched fabric in a similar manner to the underwire channel of conventional underwire bras, but the wireless support channel 20 preferably does not include a rigid underwire material.

Turning now to the breast pockets 4, 6, FIG. 1 shows the first breast pocket 4 and the second breast pocket 6 connected at lower ends to the upper edge portion 12 of the frontal portion 2. The first breast pocket 4 includes a cup portion **4*c* configured to hold the right breast and a shoulder portion 4*s* extending towards a position above the right shoulder (RS). Similarly, the second breast pocket 6 includes a cup portion 6*c* configured to hold the left breast and a shoulder portion 6*s*** extending towards a position above the left shoulder (LS).

As shown in FIG. 1, the first and second breast pockets 4,6 are in a first position covering the wearer's breasts. The first breast pocket 4 may be moved towards a second position (indicated by broken line in FIG. 1) by pulling the first breast pocket 4 down and towards right lateral side (R) of the wearer's torso (T) to uncover and expose the breast. Similarly, the second breast pocket 6 may be moved towards a second position by pulling the second breast pocket 6 down and towards left lateral side (L) of the wearer's torso (T). A breast pocket in the second position can be returned to the first position by pulling the breast pockets over the wearer's breasts to cover the breast.

In FIG. 1, the first and second breast pockets 4,6 are attached to the frontal portion 2 such that a portion of the second breast pocket 6 overlaps a portion of the first breast pocket 4. A portion of the first breast pocket 4 may alternatively overlap a portion of the second breast pocket 6. Suitably, the first and second breast pockets 4,6 may be attached to the frontal portion 2 so that neither overlaps the other.

The first breast pocket 4 and the second breast pocket 6 may be suitably formed from stretchable, elastic fabric to accommodate the wearer's breast and may be include gathers 22 to provide additional fabric for further increasing the cup size. The first and second breast pockets 4,6 may each further include an inner lining (not shown). Optionally, the inner lining may be self-fabric. Inner facing surfaces of the first and second breast pockets 4, 6 may suitably be seamless.

Turning now to FIG. 3, the back portion 8 is shown comprising a first segment of elastic material 24 and a second segment of elastic material 26. The first segment of elastic material 24 extends from the position along the left lateral side (L) of the wearer's torso (T) across a back side of the wearer's torso (T) to an area above the wearer's right shoulder (RS). The second segment of the elastic material 26 extends from the position along the right lateral side (R) of the wearer's torso (T) across the back side of the wearer's torso (T) to an area above the wearer's left shoulder (LS). Together, the first segment of elastic material 24 and the second segment of elastic material 26 form an 'X' across the back side of the wearer's torso (T).

Optionally, the first segment of elastic material 24 may be anchored to a seam 10 joining the frontal portion 2 and back portion 8 along the left lateral side (L) of the wearer's torso (T) and connected by a seam 13 to the first breast pocket 4 above the wearer's right shoulder (RS). Similarly, the second segment of elastic material 26 may be anchored to a seam 11 joining the frontal portion 2 and back portion 8 along the right lateral side (R) of the wearer's torso (T) and connected by a seam 15 to the second breast pocket 6 above the wearer's left shoulder (LS).

As shown in FIG. 3, the first segment of elastic material 24 and the second segment of elastic material 26 are generally elongated strips having lengths suitable to extend from a lateral side of the wearer's torso (T) across the backside of the wearer's torso to the opposite shoulder. The first segment and the second segment 24, 26 may be of variable width along each segment or may be of constant width. The segments of elastic material 24, 26 may be formed of a stretchable fabric, such as power mesh material or the like. One or both segments of elastic material 24, 26 may be bias cut. The material comprising the first segment of elastic material 24 and the second segment of elastic material 26 may be the same material as the front elastic material 16 of the frontal portion 2. Further, the material forming the front elastic material 16 and/or the first and second segments 24, 26 may optionally have substantially the same moduli of elasticity.

As seen in FIGS. 3 and 4, the back portion 8 may further include a back covering portion 28 overlapping the first segment of elastic material 24 and the second segment of elastic material 26. The first segment of elastic material 24 and the second segment of elastic material 26 may extend along an inner surface 32 of the back covering portion 28 such that the segments of elastic material are not visible from the exterior of the garment 1, as seen best in FIG. 4.

The back covering portion 28 includes a horizontal segment 27 extending across the backside of the wearer's torso from a position along the left lateral side (L) of the wearer's torso (T) and under the wearer's left arm to a position along the right lateral side (R) of the wearer's torso (T) and under the wearer's right arm. The back covering portion 28 also has a left shoulder segment 29*a* and a right shoulder segment 29*b* extending upward from the horizontal segment 27 to positions above the wearer's left shoulder (LS) and right shoulder (RS), respectively. The back covering portion 28 may be connected to the frontal portion 2 by the horizontal segment 27 at a position along the left lateral side (L) by seam 10 and by the horizontal segment 27 at a position along the right lateral side (R) of the wearer's torso (T) by seam 11. The right shoulder segment 29*b* of the back covering portion 28 may also be connected to shoulder portion 4*s* of the first breast pocket 4 at a position above the right shoulder (RS) by seam 13. The left shoulder segment 29*a* of the back covering portion 28 may also be connected to the shoulder portion 6*s* of the second breast pocket 6 at a position above the left shoulder (LS) by seam 15.

In one embodiment, the first segment of elastic material 24 and the second segment of elastic material 26 may be fixed to a back covering portion 28 of the back portion 8 by seams (not shown) extending along perimeter edges of the first segment of elastic material 24 and the second segment of elastic material 26.

Additionally, the back portion 8 may further include an inner lining (not shown) attached to the back covering portion 28 facing the inner surface 32. The inner lining may be self-fabric. If included, the inner lining of the back portion 8 may be seamless.

The first segment of elastic material 24 and the second segment of elastic material 26 may be positioned between the back covering portion 28 and an inner lining of the back portion 8. The first segment of elastic material 24 and the second segment of elastic material 26 may be additionally or alternatively fixed to the inner lining of the back portion 8 by seams (not shown) extending along perimeter edges of the first segment of elastic material 24 and the second segment of elastic material 26. Fixing the first segment of elastic material 24 and the second segment of elastic material 26 to the inner lining and not to the back covering portion 28 allows for the back portion 8 to appear visibly seamless from the outside of the garment 1.

As shown in FIG. 3, the back portion 8 may further include an elastic band 34 extending across a backside of the wearer's torso (T). The elastic band 34 may extend from a position along the left lateral side (L) across the backside of the wearer's torso (T) to a position along the right lateral side (R) of the wearer's torso (T). The elastic band 34 of the back portion 8 is may be connected to the elastic band 17 of the frontal portion 2 such that the elastic bands 34 and 17 join together to encircle the wearer's torso (T). The elastic bands 34 and 17 may be formed from a single piece of elastic or separate pieces joined together.

The first and second breast pockets 4, 6 may also comprise elastic hems located at lateral sides of said breast pockets 4, 6 at perimeter edges 51. Similarly, the back portion 8 may also comprise elastic hems located at perimeter edges 50. Elastic hems may be formed by stitching an elastic material along outer hemlines and may contribute to the fit and supportiveness of the garment 1.

It will be appreciated that this disclosure is not limited to nursing garments configured as pull-over bras. As shown in FIGS. 6-9 by various views, this disclosure further provides an exemplary nursing garment 100 configured as a camisole or tank-top shirt. Nursing garment 100 includes a first breast pocket 104 and a second breast pocket 106. The first breast pocket 104 and second breast pocket 106 may be similar to the breast pockets 4, 6 of nursing garment 1 and are configured to be moveable from a first position in which a breast pocket covers at least one of the wearer's breasts to a second position in which the wearer's breast is uncovered and exposed.

Figure 6:
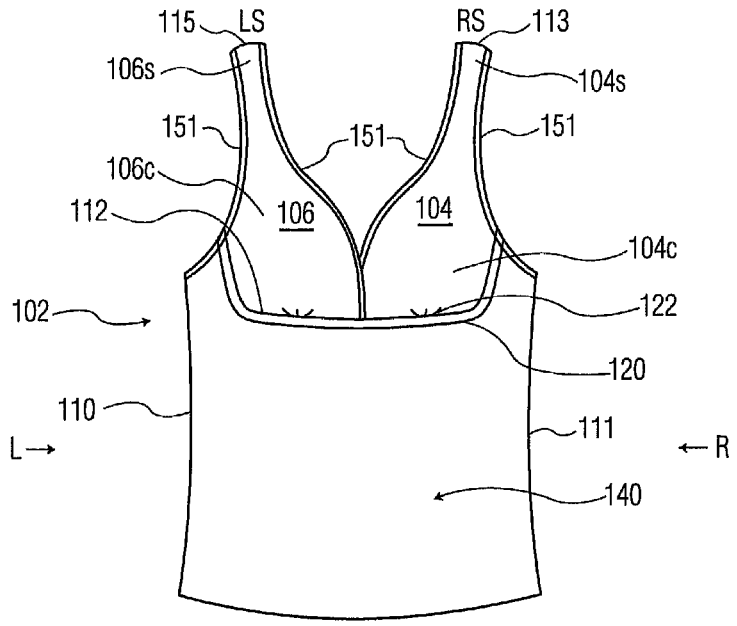
FIG. 6 is a front view of an exterior of a front side of an exemplary alternative nursing garment.

As shown in FIG. 6, the nursing garment 100 additionally includes a frontal portion 102 formed from at least one layer of fabric material extending across a front side of a wearer's torso (T) and an upper edge portion 112 that extends horizontally across the wearer's torso (T) under a wearer's breasts adjacent a wearer's inframammary line (IL) and curves along a wearer's inframammary crease (IC) at outer lateral sides of the wearer's breasts. The frontal portion 102 may optionally include a wireless support channel 120 as shown. The frontal portion 102 also includes a lower front portion 140 extending away from the upper edge portion 112 and configured to cover at least a portion of the abdomen or stomach area of the wearer's torso (T). While not required, the lower front portion 140 may include a power mesh panel (not shown) configured to provide support and shaping to the wearer's frontal abdomen region, which may include the wearer's mid-section.

Figure 7:
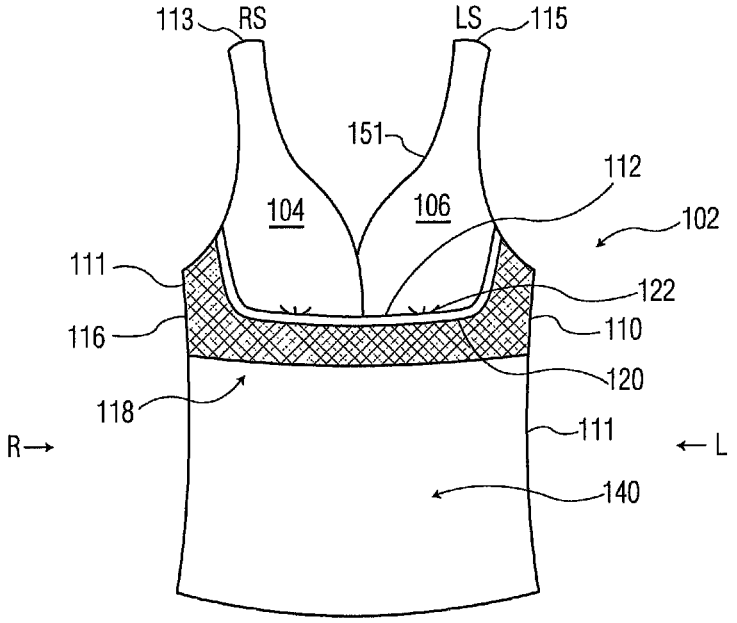
FIG. 7 is a view of an interior of the front side of the exemplary alternative nursing garment shown in FIG. 6.

As seen in FIG. 7, the frontal portion 102 may further include a front elastic material 116 extending along at least a portion of an inner surface 118 of the lower front portion 140 of the frontal portion 102 to support the breasts. If included, the front elastic material 116 may extend horizontally across a front side of the wearer's torso (T) under a wearer's breasts from a position along the left lateral side (L) of the wearer's torso (T) to a position along the right lateral side (R) of the wearer's torso (T). The front elastic material 116 may be anchored to seam 110 along the left lateral side (L) of the wearer's torso (T) and to seam 111 along the right lateral side (R) of the wearer's torso (T). The front elastic material 116 may be formed of a stretchable fabric, such as power mesh material or the like.

While not required, the frontal portion 102 may also include an elastic band (not shown) to hold and support the breasts. Like the elastic band 17 of the nursing garment 1, the elastic band of the nursing garment 100 may extend from a position along the left lateral side (L) of the wearer's torso horizontally across a front side of the wearer's torso (T) under a wearer's breasts to a position along the right lateral side (R) of the wearer's torso (T).

Figure 8:
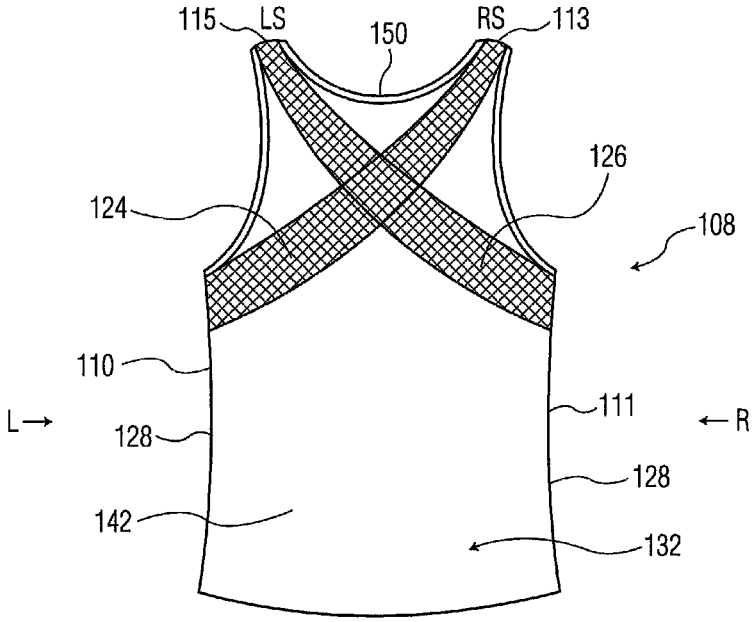
FIG. 8 is a view of the interior of a back side of the exemplary alternative nursing garment shown in FIG. 6.

As shown in FIG. 8, the nursing garment 100 includes a back portion 108 for providing back support. The back portion 108 includes a first segment of elastic material 124 and a second segment of elastic material 126. Similar to nursing garment 1, the first segment of elastic material 124 extends from the position along the left lateral side (L) of the wearer's torso (T) across a back side of the wearer's torso (T) to an area above the wearer's right shoulder (RS) and the second segment of the elastic material 126 extends from the position along the right lateral side (R) of the wearer's torso (T) across the back side of the wearer's torso (T) to an area above the wearer's left shoulder (LS). Together, the first segment of elastic material 124 and the second segment of elastic material 126 form an 'X' across the back side of the wearer's torso (T).

Figure 9:
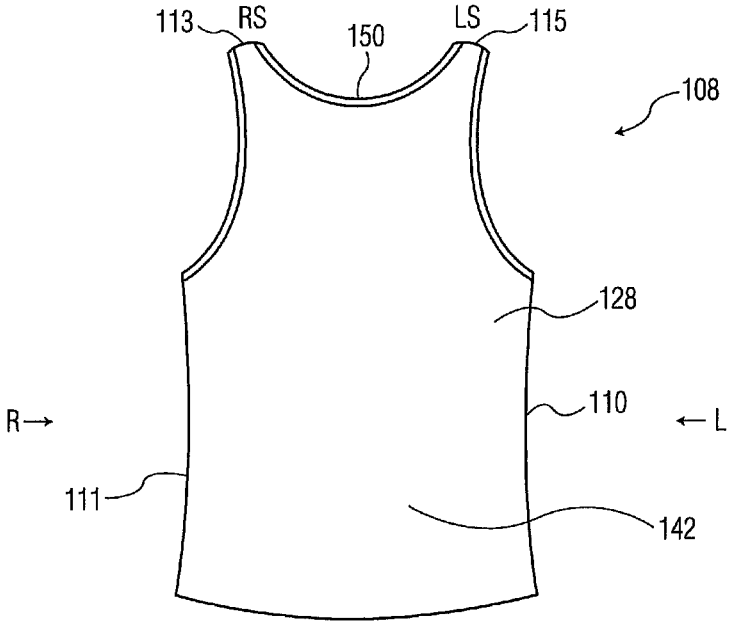
FIG. 9 is a rear view of an exterior of the back side of the alternative exemplary nursing garment shown in FIG. 6.

As seen in FIGS. 8 and 9, the back portion 108 may include a back covering portion 128 having a lower back portion 142 extending downwards and configured to cover at least a portion of the back side of the abdomen area of the wearer's torso (T). The back portion 108 (including the lower back portion 142) and the frontal portion 102 (including the lower front portion 140) may be connected along the left lateral side (L) and right lateral side (R) of the wearer's torso (T) to form a tubular shape configured to encircle and cover the abdomen area of the torso (T). While not required, the lower back portion 142 may also include a power mesh panel (not shown) configured to provide support and shaping to the wearer's abdomen and back. The back portion 108 may optionally include an inner lining (not shown).

Figure 10:
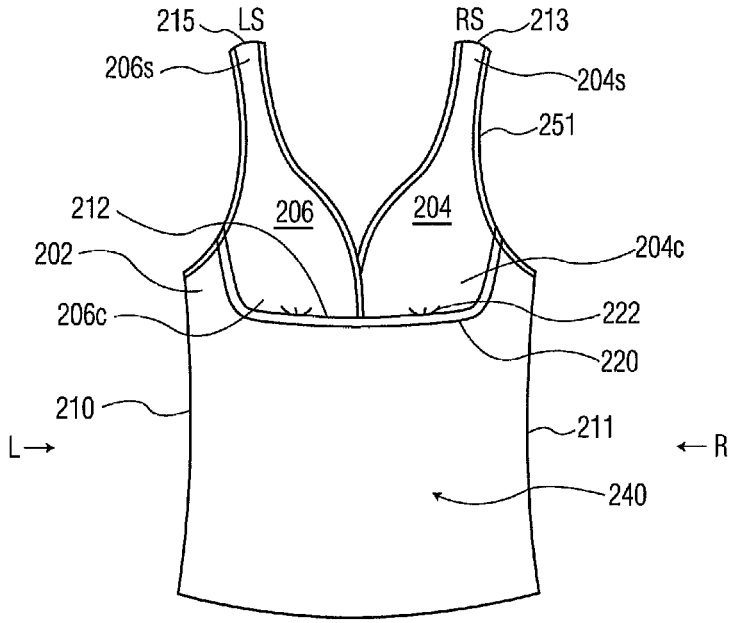
FIG. 10 is a front view of an exterior of a front side of a further exemplary alternative nursing garment.
Figure 11:
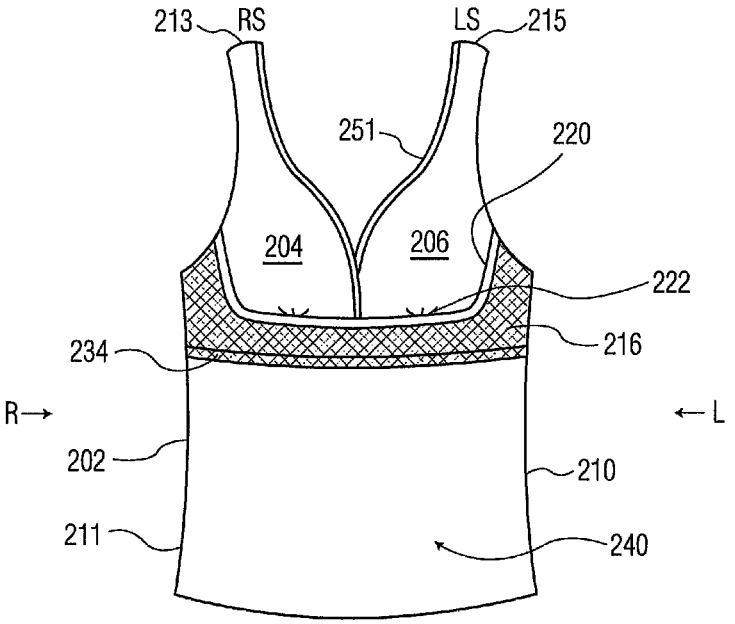
FIG. 11 is a view of an interior of the front side of the further exemplary alternative nursing garment shown in FIG. 10.
Figure 12:
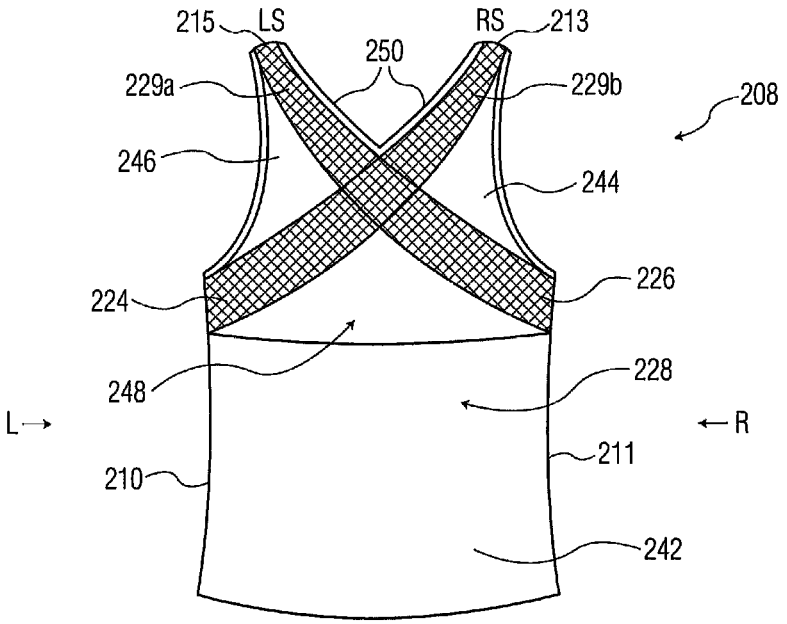
FIG. 12 is a view of an interior of a back side of the further exemplary alternative nursing garment shown in FIG. 10.
Figure 13:
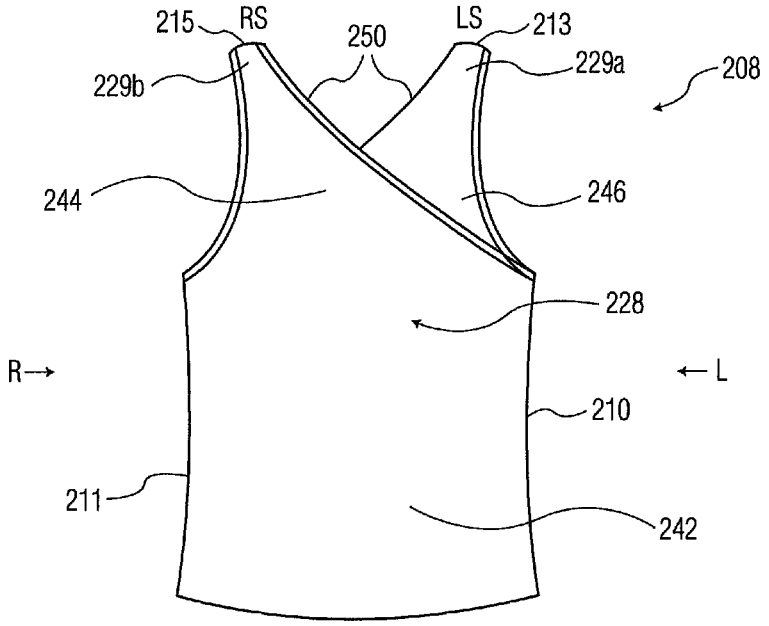
FIG. 13 is a rear view of an exterior of the back side of the further exemplary alternative nursing garment shown in FIG. 10.

As shown in FIGS. 10-13 by various views, this disclosure provides further alternative exemplary nursing garments 200 suitably configured as camisoles or tank-top shirts. As shown in FIGS. 10 and 11, the frontal portion 202 with a lower front portion 240, first breast pocket 204 and second breast pocket 206 may be similar to like structures of the nursing garment 100 shown in FIGS. 6 and 7. As seen in FIGS. 12 and 13, the back portion 208 also includes first segment of elastic material 224 and second segment of elastic material 226 configured to form an "X" shape across the backside of the wearer's torso (T).

As seen best in FIG. 13, the back portion 208 of the nursing garment 200 includes a back covering portion 228 having two partially overlapping first and second back segments 244, 246. The first back segment 244 includes a lower back portion 242 extending downwards configured to cover at least a portion of the back side of the abdomen area of the wearer's torso (T). The first back segment 244 is connected the frontal portion 202 along both the left lateral side (L) by seam 210 and right lateral side (R) of the wearer's torso (T) by seam 211. The lower back portion 242 of the back portion 208 and the lower front portion 240 of the frontal portion 202 are configured to form a tubular shape adapted to encircle and cover the abdomen area of the torso (T). The first back segment 244 also includes a right shoulder segment **229*b* extending towards a position above the right shoulder (RS). The right shoulder segment 229*b* is connected to the first breast pocket 204 at a position above the right shoulder (RS) at seam 213**.

The second back segment 246 includes a lower portion 248 that may be connected the frontal portion 202 along the left lateral side (L) and right lateral side (R) of the wearer's torso (T). While not required, the lower portion 248 may extend downwards to cover the back side of the abdomen area of the wearer's torso (T). Alternatively, the lower portion 248 may not extend substantially lower than positions at which the second segment of elastic material 226 is connected to the right lateral side (R) of the back portion 208. The second back segment 246 also includes a left shoulder segment **229*a* extending towards a position above the left shoulder (LS). The left shoulder segment 229*a* connected to the second breast pocket 206 at a position above the left shoulder (LS) at seam 215**.

Alternatively, the garment 200 depicted in FIGS. 10 to 13 may include a back portion 208 similar to the back portion of garment 100 depicted in FIGS. 8 and 9. For example, instead of two overlapping segments, the back portion 208 may include a unitary back covering portion having a lower back portion extending downwards and configured to cover at least a portion of the back side of the abdomen area of the wearer's torso (T).

The garments of this disclosure may be manufactured from any suitable knit or woven fabric, including but not limited to jersey knit fabrics. Exemplary materials include but are not limited to one or more of cotton, polyester, rayon, nylon, spandex, modal, LYCRA spandex and the like. As yet another option, edges of any of the garments described herein may include an edge finishing to improve its comfort, look and our durability. For example, garment edges that surround a wearer's arms, neckline and/or torso may be finished with a self-folder binding or any other desired edge finishing. Furthermore, it will be appreciated that reference to the garments of this disclosure as nursing garments does not restrict their use to nursing mothers during breastfeeding. The garments may be suitably worn during pregnancy or by those who are not pregnant, and of any age, shape, size and/or gender, such as during athletic activities, sleeping, lounging, or any other activity without departing from this disclosure.

Although the garments have been described in connection with specific forms thereof, it will be appreciated that a wide variety of equivalents may be substituted for the specified elements described herein without departing from the spirit and scope of this disclosure as described in the appended claims.

What is claimed is:

1. A garment comprising:

a frontal portion configured to extend across a front side of a wearer's torso and has an upper edge portion that extends horizontally across the wearer's torso adjacent to a wearer's inframammary line and curves along a wearer's inframammary crease at outer lateral sides of a wearer's breasts;

a back portion comprising a first segment of elastic material that is configured to extend from a position along a left lateral side of the wearer's torso across a back side of the wearer's torso to an area above a wearer's right shoulder, and a second segment of the elastic material that is configured to extend from a position along a right lateral side of the wearer's torso across the back side of the wearer's torso to an area above a wearer's left shoulder, such that the first and second segments form an 'X' across said back side;

a first breast pocket comprising an upper end that is configured to connect to the first segment of the back portion at the area above the wearer's right shoulder and a lower end connected to the upper edge portion of the frontal portion; and a second breast pocket comprising an upper end that is configured to connect to the second segment of the back portion at the area above the wearer's left shoulder and a lower end connected to the upper edge portion of the frontal portion, wherein at least one of the first and second breast pockets is configured to cover at least one of the wearer's breasts when said breast pocket is in a first position, and to uncover and expose the at least one of the wearer's breasts when in a second position, and wherein the frontal portion and the upper edge portion of the frontal portion are configured to remain in place to support the wearer's breasts whether one or both of the first and second breast pockets are in the first position or in the second position.

2. The garment of claim 1, wherein the first segment of elastic material and the second segment of elastic material are configured to support a wearer's back.

3. The garment of claim 1, wherein the elastic material comprises a power mesh material.

4. The garment of claim 1, wherein the elastic material is bias cut.

5. The garment of claim 1, wherein the first segment and the second have a variable width.

6. The garment of claim 1, wherein the first segment and the second segment have a constant width.

7. The garment of claim 1, wherein the frontal portion further comprises a third segment of elastic material that is configured to extend from the position along the left lateral side of the wearer's torso across the front side of the wearer's torso to the position along the right lateral side of the wearer's torso.

8. The garment of claim 7, wherein the third segment of elastic material is configured to attach to the first elastic material at a position along the left lateral side of the wearer's torso and configured to attach to the second elastic material at a position along the right lateral side of the wearer's torso.

9. The garment of claim 1, wherein a portion of one of said breast pockets overlaps a portion of the other of said breast pockets.

10. The garment of claim 1, wherein the back portion further comprises a back covering portion, the back covering portion having (a) a horizontal segment configured to extend across the back side of the wearer's torso from the position along the left lateral side of the wearer's torso to the position along the right lateral side of the wearer's torso and (b) left and right shoulder segments configured to extend upward from the horizontal segment to the area above the wearer's left shoulder and the area above the wearer's right shoulder.

11. The garment of claim 10, wherein the first segment of elastic material and the second segment of elastic material are fixed to the back covering portion by seams extending along perimeter edges of the first segment of elastic material and the second segment of elastic material.

12. The garment of claim 1, further comprising an elastic band configured to extend across the front side of the wearer's torso from the position along the left lateral side of the wearer's torso to the position along the right lateral side of the wearer's torso.

13. The garment of claim 12, wherein the elastic band is configured to attach to a portion of the frontal portion at a position extending horizontally across the wearer's torso under the wearer's breasts.

14. The garment of claim 1, wherein at least one of the front portion, the back portion, and the first and second breast pockets comprise an inner lining.

15. The garment of claim 1, wherein the first segment of elastic material and the second segment of elastic material are fixed to an inner lining of the back portion by seams extending along perimeter edges of the first segment of elastic material and the second segment of elastic material.

16. The garment of claim 10, wherein the first elastic material and second elastic material are positioned between the back covering portion and an inner lining of the back portion.

17. The garment of claim 1, wherein the frontal portion of the garment further comprises a wireless support channel extending along the upper edge portion.

18. The garment of claim 17, wherein the wireless support channel is flexible and resists expansion.

19. The garment of claim 17, wherein the wireless support channel is configured to extend horizontally across the wearer's torso under the wearer's breasts adjacent the wearer's inframammary line and curve along the wearer's inframammary crease at outer lateral sides of the wearer's breasts.

20. The garment of claim 17, wherein the wireless support channel is connected to the upper edge portion such that the wireless support channel is located between the first and second breast pockets and the upper edge portion.

21. The garment of claim 1, wherein the first and second breast pockets further comprise elastic hems located at lateral sides of said breast pockets.

22. The garment of claim 1, wherein inner facing surfaces of the frontal portion, back portion and first and second breast pockets are seamless.

23. The garment of claim 1, wherein the garment comprises at least one fabric selected from the group consisting of cotton, polyester, rayon, nylon, spandex, modal and LYCRA spandex.

24. The garment of claim 1, wherein the frontal portion comprises a lower front portion extending away from the upper edge portion of the frontal portion and the back portion comprises a lower back portion extending downward, and wherein the lower front portion and the lower back portion are configured to encircle a wearer's abdomen.

25. The garment of claim 24, wherein at least one of the lower front portion and the lower back portion further comprises a power mesh panel configured to provide support and shaping to the wearer's abdomen and a wearer's back.

26. The garment of claim 24, wherein the back portion comprises two overlapping back segments wherein a first back segment is connected to the first breast pocket and a second back segment is connected to the second breast pocket.

* * * * *